US008827187B2

(12) United States Patent
Kobayashi

(10) Patent No.: US 8,827,187 B2
(45) Date of Patent: Sep. 9, 2014

(54) FUEL INJECTION VALVE AND INTERNAL COMBUSTION ENGINE

(75) Inventor: Tatsuo Kobayashi, Susono (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 805 days.

(21) Appl. No.: 13/120,881

(22) PCT Filed: Jul. 1, 2010

(86) PCT No.: PCT/JP2010/061239

§ 371 (c)(1),
(2), (4) Date: Mar. 24, 2011

(87) PCT Pub. No.: WO2012/001802

PCT Pub. Date: May 1, 2012

(65) Prior Publication Data

US 2012/0000996 A1 Jan. 5, 2012

(51) Int. Cl.

| | |
|---|---|
| ***F02M 61/10*** | (2006.01) |
| ***F02M 61/04*** | (2006.01) |
| ***F02M 61/16*** | (2006.01) |
| ***F02M 67/12*** | (2006.01) |
| ***F02M 57/04*** | (2006.01) |

(52) U.S. Cl.

CPC ..... *F02M 61/163* (2013.01); *F02M 67/12* (2013.01); *F02M 57/04* (2013.01)

USPC ..... 239/533.2; 239/399; 239/403; 239/405; 239/416.5; 239/486; 239/601

(58) Field of Classification Search

USPC ..... 239/398, 399, 403, 405, 413, 416.4, 239/416.5, 417.3, 463, 486, 533.2, 533.3, 239/533.11, 533.12, 584, 601; 123/445, 123/470

See application file for complete search history.

(56) References Cited

U.S. PATENT DOCUMENTS

| | | | |
|---|---|---|---|
| 1,252,254 | A | 1/1918 | Fisher |
| 1,657,395 | A | 1/1928 | Held |

(Continued)

FOREIGN PATENT DOCUMENTS

| | | | |
|---|---|---|---|
| CN | 1379847 | A | 11/2002 |
| DE | 102 14 096 | A1 | 10/2002 |

(Continued)

OTHER PUBLICATIONS

Extended European Search Report for corresponding EP Patent Application No. 10849444.4 dated Aug. 23, 2013.

(Continued)

*Primary Examiner* — Darren W Gorman
(74) *Attorney, Agent, or Firm* — Sughrue Mion, PLLC

(57) ABSTRACT

A fuel injection valve includes: a nozzle body provided with an injection hole at a tip portion; a needle that is located slidably in the nozzle body and includes a seat portion seated on a seat position in the nozzle body; and an air bubble generation means generating air bubbles in a fuel flowing through the nozzle body, and when a curvature radius is R, a length of a curve is L and a constant is a, an inner peripheral shape of the injection hole includes a curving part passing through a region surrounded by a clothoid curve which is expressed by $R \times L = a^2$ and of which the constant a is 0.95 and an clothoid curve of which the constant a is 1.05 or a region surrounded by approximate curves of the clothoid curves at a cross-section surface along a direction of axis of the injection hole.

6 Claims, 14 Drawing Sheets

(56) References Cited

U.S. PATENT DOCUMENTS

| | | | | |
|---|---|---|---|---|
| 2,974,881 | A | 3/1961 | Garday | |
| 4,060,199 | A | 11/1977 | Brüne et al. | |
| 5,148,788 | A | 9/1992 | Saikalis et al. | |
| 5,224,458 | A * | 7/1993 | Okada et al. | 123/531 |
| 5,666,927 | A * | 9/1997 | Pace et al. | 123/533 |
| 5,730,367 | A * | 3/1998 | Pace et al. | 239/408 |
| 6,209,806 | B1 | 4/2001 | Pace et al. | |
| 6,918,549 | B2 | 7/2005 | Theodorof | |
| 2006/0131447 | A1 | 6/2006 | Masuda et al. | |
| 2008/0105767 | A1 * | 5/2008 | Fujii et al. | 239/533.2 |
| 2012/0056018 | A1 | 3/2012 | Kobayashi | |

FOREIGN PATENT DOCUMENTS

| | | | |
|---|---|---|---|
| JP | 61-129461 | A | 6/1986 |
| JP | 61-145356 | A | 7/1986 |
| JP | 5-056263 | A | 7/1993 |
| JP | 06-317231 | A | 11/1994 |
| JP | 8-500164 | A | 1/1996 |
| JP | 09-088610 | A | 3/1997 |
| JP | 10-141183 | A | 5/1998 |
| JP | 10-176631 | A | 6/1998 |
| JP | 11-200994 | A | 7/1999 |
| JP | 2000-009002 | A | 1/2000 |
| JP | 2000-154768 | A | 6/2000 |
| JP | 2001-182641 | A | 7/2001 |
| JP | 2002-357169 | A | 12/2002 |
| JP | 2003-120472 | A | 4/2003 |
| JP | 2003-148302 | A | 5/2003 |
| JP | 2005-315136 | A | 11/2005 |
| JP | 2006-116365 | A | 5/2006 |
| JP | 2006-177174 | A | 7/2006 |
| JP | 2008-025485 | A | 2/2008 |
| JP | 2008-138609 | A | 6/2008 |
| JP | 2008-237995 | A | 10/2008 |
| JP | 2009-011932 | A | 1/2009 |
| JP | 2010-112196 | A | 5/2010 |
| WO | 01/29406 | A1 | 4/2001 |

OTHER PUBLICATIONS

Office Action for U.S. Appl. No. 13/141,942 issued on Jul. 23, 2013.

* cited by examiner

FUEL INJECTION VALVE AND INTERNAL COMBUSTION ENGINE

This is a National Stage of International Application No. PCT/JP2010/061239 filed Jul. 1, 2010, the contents of all of which are incorporated herein by reference in their entirety.

TECHNICAL FIELD

The present invention relates to a fuel injection valve and an internal combustion engine.

BACKGROUND ART

There has been conventionally suggested a mechanism of a nozzle in which a mixing chamber where oil and the like is mixed with compressed air is formed, the nozzle injecting a mixture of liquid and gas (e.g. see Patent Document 1).

Patent Document 1: Japanese Patent Application Publication No. 2009-11932

DISCLOSURE OF THE INVENTION

Problems to be Solved by the Invention

It is known that it is effective to downsize the atomized particle size of the injected fuel for improving the fuel consumption of the internal combustion engine and the exhaust emission. It is considered that Patent Document 1 allows a mixture of fuel and air to be accelerated, and allows the atomized particle size to be downsized.

However, when the fuel into which air bubbles are mixed is injected from an injection hole, depending on conditions around the injection hole, air bubbles may collapse and an air bubble size may become non-uniform. If the air bubble size is non-uniform, it is difficult to achieve a uniform spray.

It is an object of the present invention to equalize the atomized spray particle size.

Means for Solving the Problems

According to an aspect of the present invention, there is provided an fuel injection valve characterized by including: a nozzle body which is provided with an injection hole at a tip portion; a needle that is located slidably in the nozzle body and includes a seat portion which is seated on a seat position in the nozzle body; and air bubble generation means that generates air bubbles in a fuel flowing through the nozzle body, wherein in a case where a curvature radius is R, a length of a curve is L and a constant is a, an inner peripheral shape of the injection hole includes a curving part passing through a region surrounded by a clothoid curve which is expressed by $R \times L = a^2$ and of which the constant a is 0.95 and an clothoid curve of which the constant a is 1.05 or a region surrounded by approximate curves of the clothoid curves at a cross-section surface along a direction of axis of the injection hole.

As a curving part formed by a clothoid curve or an approximate curve of the clothoid curve is included, a separation of the fuel flow therein is suppressed. If the separation occurs in an inner wall surface of the injection hole when the fuel flow including air bubbles generated by the air bubble generation means is injected to the outside through the injection hole, the fuel flow is affected by negative-pressure thereof, and an air bubble size becomes large. The negative pressure has a greater effect on the outer part of the fuel flow than on the inner part of the fuel flow. That is to say, the distribution of the negative pressure affecting the fuel flow is inhomogeneous.

This causes non-uniformity in the air bubble size. When a clothoid curve or an approximate curve of a clothoid curve is applied to the inner peripheral shape of the injection hole, the fuel passing through the injection hole can attain the Coanda effect by which the fuel is drawn to a wall surface including a relaxation curve connecting a straight line to a circular arc with its viscosity. Due to the Coanda effect, the fuel flow does not separate from the inner wall surface of the injection hole. Therefore, a streamline direction of the fuel changes without the occurrence of negative-pressure at the boundary surface. In addition, the streamline of the fuel flowing in the inner side of the boundary surface is affected by the fuel flowing over the boundary surface due to its viscosity and is bent. As described, as the streamline of the fuel gradually changes through the center region of the injection hole, the fuel flow can keep almost even flow velocity and pressure throughout all regions in the injection hole, and spread the spray angle.

A clothoid curve is expressed by $R \times L = a^2$ when a curvature radius is R, a length of a curve is L, and a constant is a. The locus of a clothoid curve varies by varying the constant a. The constant a can be set so that the locus becomes the one which achieves a desired spray shape. The constant a is determined in response to the wall thickness of a nozzle body to which the injection hole is provided, the injection hole length, and the spray angle, for example. Thus, it is possible to determine the inner peripheral shape of the injection hole in view of possible ranges of the general wall thickness of the nozzle body, the general injection hole length, and the general spray angle. Specifically, the inner peripheral shape of the injection hole may be a shape including a curving part that passes through a region surrounded by a clothoid curve of which the constant a is 0.95 and a clothoid curve of which the constant a is 1.05. That is to say, the inner peripheral shape of the injection hole may be a shape including a curving part included in the above region in addition to a curving part that completely corresponds to a clothoid curve.

Here, the value 0.95 of the constant a is determined based on the fact that if the constant becomes smaller than this value, the fuel is not injected properly and adheres to the exit of the injection hole, which means that a so-called sprayed-fuel dripping easily occurs as a result of the experiment. When the sprayed-fuel dripping occurs, fuel particles tend to become large, and the achievement of the uniform atomized particle size is prevented. On the other hand, the value 1.05 of the constant a is determined based on the fact that if the constant is larger than this value, the phenomenon of the joining of generated fine air bubbles easily occurs as a result of the experiment. When the joining of fine air bubbles occurs, it prevents the achievement of uniform atomized particle size. As described above, the value of the constant a is defined as a range with which occurrences of the sprayed-fuel dripping and the joining of fine air bubbles are suppressed.

Moreover, the inner peripheral shape of the injection hole may be a shape including a curving part that passes thorough a region surrounded by approximate curves of clothoid curves. That is to say, even in a case where the curving part deviates from the region surrounded above clothoid curves, the inner peripheral shape of the injection hole may be a shape including a curving part included in the region surrounded by approximate curves of clothoid curves. Here, the approximate curve of the clothoid curve is expressed by $Y = X^b/c$ when X is the axial-direction length of the injection hole, Y is the radial-direction length of the injection hole, and b and c are constants, and the region surrounded by approximate curves of the clothoid curves may be a region surrounded by an approximate curve of which the constant b is 3.3 and the constant c is 5.0, and an approximate curve of which the constant b is 3.3 and the constant c is 6.3. The approximate curve of which the constant c is 5.0 approximates a clothoid curve of which the constant a is 0.95, and the approximate curve of which the constant c is 6.3 approximates a clothoid curve of which the constant a is 1.05.

Here, a curve of which the difference from an original clothoid curve is within 20 um in a range that is equal to or smaller than the value adopted as a half angle of spray in the fuel injection valve (e.g. half angle of spray θ=40°) can be selected as an approximate curve of a clothoid curve. To select an approximate curve, a method conventionally known may be applied. For example, an approximate curve may be selected by plotting arbitrary points on a clothoid curve and applying a least-square method to those points. An approximate curve of a clothoid curve can be selected in view of the machining of the inner peripheral shape of the injection hole. That is to say, a curve, with which the same Coanda effect as a clothoid curve can be attained and the machining of the inner peripheral shape of the injection hole is easy, can be selected.

The curving part passing through above region may have any shape, but it is desirable to have a shape with which the Coanda effect can be attained as far as possible.

The inner peripheral shape of the injection hole may be a shape including a curving part formed by connecting a clothoid curve or an approximate curve of a clothoid curve with a circular arc at the cross-section surface along the direction of axis of the injection hole. It is possible to make the spray angle close to 180° by providing a circular part at the exit side of the injection hole. It is possible to shorten a spray distance by making the spray angle wide. When connecting a clothoid curve with a circular arc, the circular arc may be a circular arc of an inscribed circle of a clothoid curve at the connected part. In addition, when a curve formed by connecting a clothoid curve with a circular arc is adopted, the similar figure of the curve can be adopted to the inner peripheral shape of the injection hole.

The fuel injection valve described in the specification is the one which injects the fuel including air bubbles generated inside the fuel injection valve to the outside through the injection hole. Thus, the fuel injection valve includes air bubble generation means. The means which generate cavitation to the fuel by expanding the fuel flow passage exponentially or inflecting it abruptly in the fuel injection valve may be air bubble generation means.

The air bubble generation means, which includes a fuel injection passage formed between the needle and the nozzle body with the needle being located slidably in the nozzle body; a swirl flow generator which is formed at an upstream side of the seat portion of the needle and where a spiral groove, which swirls a fuel injected from the fuel injection passage, is formed; an air induction passage formed within the needle; and a swirl stabilization chamber which is formed at the tip portion of the nozzle body and to which a fuel passing through the swirl flow generator and an air passing through the air induction passage are injected, may be adopted as the means that generates air bubbles finer than air bubbles that the air bubble generation means using cavitation generates.

An ultrasonic vibrator located in the nozzle body may be used as the air bubble generation means. The ultrasonic vibrator may be located between the nozzle body and the needle. It is possible to generate fine air bubbles in the fuel by vibrating the fuel with the ultrasonic vibrator. It is possible to spray the fuel keeping a bubble size uniform by injecting the fuel generated with the above method to the outside through the injection hole having the inner peripheral shape described above.

According to an aspect of the present invention, there is provided an internal combustion engine characterized by including: an internal combustion engine body; and a fuel injection valve which is mounted to the internal combustion engine body so that a tip portion is exposed in a combustion chamber or intake port of the internal combustion engine body, the fuel injection valve including: a nozzle body which is provided with an injection hole at a tip portion; a needle that is located slidably in the nozzle body and includes a seat portion which is seated on a seat position in the nozzle body; and air bubble generation means that generates air bubbles in a fuel flowing through the nozzle body, an inner peripheral shape of the injection hole including a curving part passing through a region surrounded by a clothoid curve, in a case where a curvature radius is R, a length of a curve is L and a constant is a, which is expressed by $R \times L = a^2$ and of which the constant a is 0.95 and an clothoid curve of which the constant a is 1.05 or a region surrounded by approximate curves of the clothoid curves at a cross-section surface along a direction of axis of the injection hole, wherein a spray angle of the injection hole becomes narrow as a distance from the injection hole to an inner wall surface of the internal combustion engine body becomes long.

As the spray angle becomes wide, the spray widens and the spray distance becomes short. On the other hand, as the spray angle becomes narrow, the spray narrows, and the spray distance becomes long. It is desired to avoid the adherence of the spray of the fuel to the inner wall surface of the internal combustion engine body, such as the inner wall surface of the combustion chamber, a top of piston, and the inner wall surface of the port in a case of port-injection, as much as possible. Thus, it is possible to set the spray angle with which the adherence of the spray to the wall surface is easily avoided in view of the mounting location and the mounting angle of the fuel injection valve to the internal combustion engine body. The spray angle is set to the proper angle by adjusting the value of the constant a which determines a clothoid curve and adjusting the injection hole length.

Effects of the Invention

According to a fuel injection valve of the present invention, it is possible to uniform the size of air bubbles mixed into the fuel to be injected, and to uniform a particle size of spray formed by the bubble collapse.

BEST MODES FOR CARRYING OUT THE INVENTION

A description will now be given, with reference to drawings, of exemplary embodiments. In drawings, the size, the proportion and the like of each portion may be not illustrated to correspond to those of actual portions completely. In some drawings, detail illustration may be omitted.

[First Exemplary Embodiment]

Figure 1A:
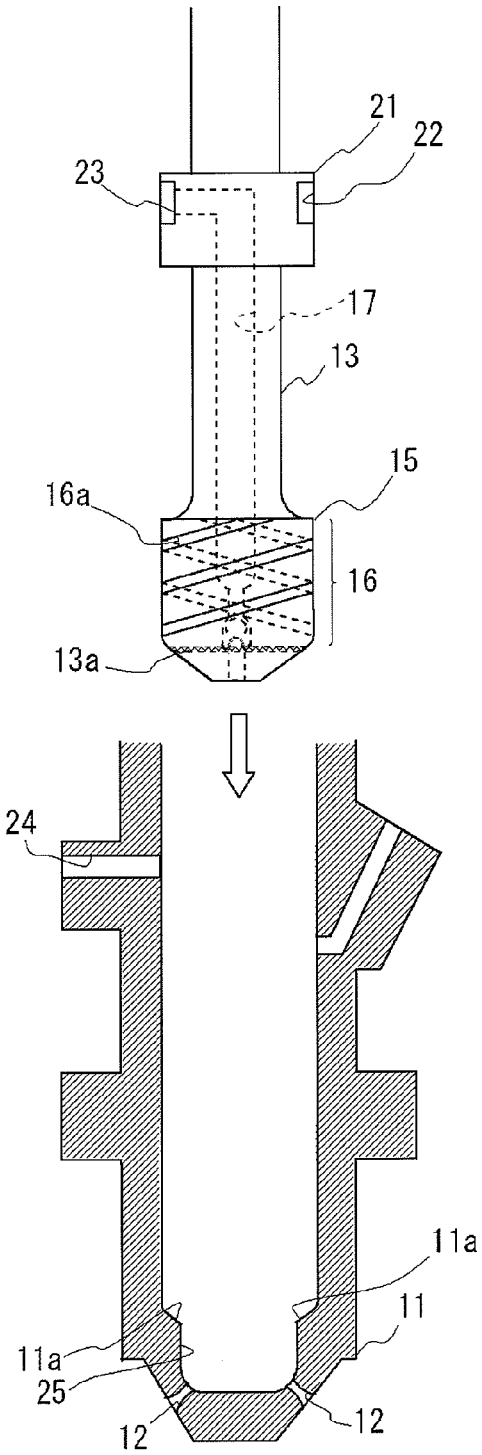
FIG. 1A is an explanatory diagram illustrating a state where a nozzle body and a needle of a fuel injection valve in accordance with a first exemplary embodiment are not combined.
Figure 1B:
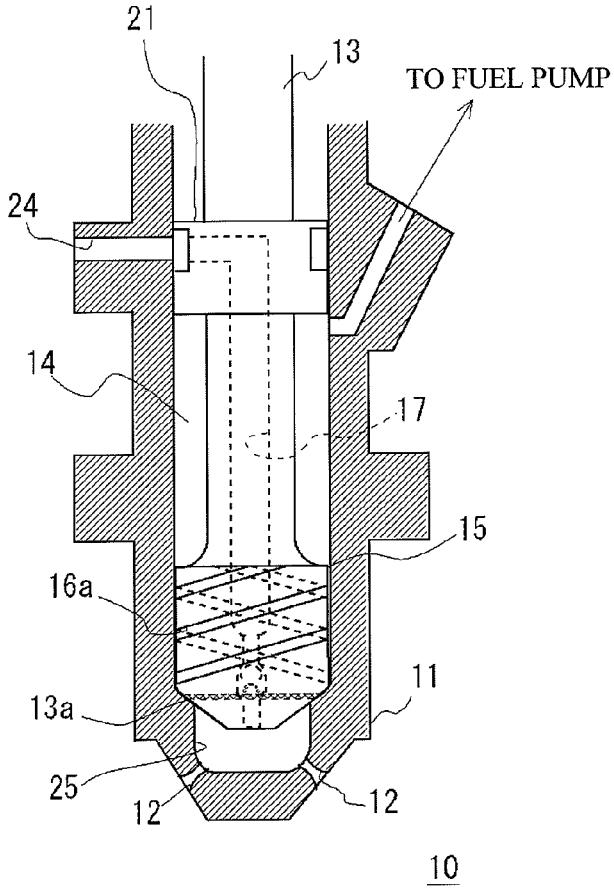
FIG. 1B is an explanatory diagram illustrating a state where the needle is implemented to the nozzle body of the fuel injection valve in accordance with the first exemplary embodiment.
Figure 2:
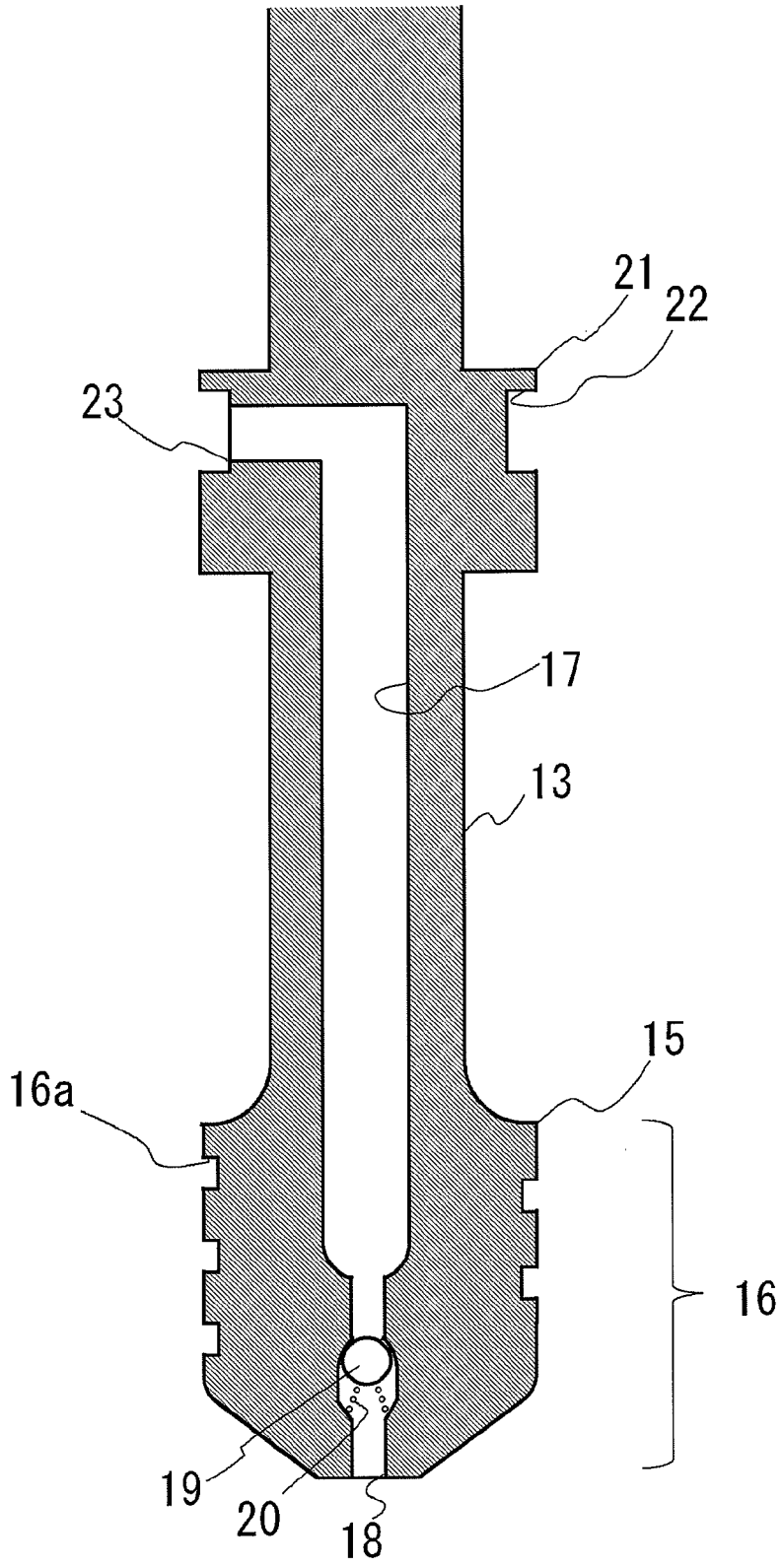
FIG. 2 is a cross-sectional view of the needle provided to the fuel injection valve in accordance with the first exemplary embodiment.
Figure 3A:
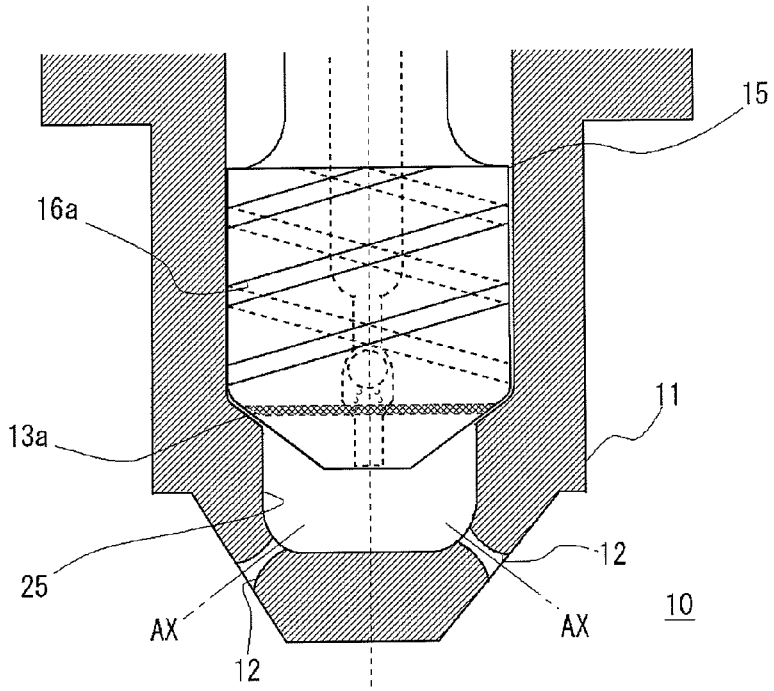
FIG. 3A is a cross-sectional view, which is taken from line A-A of FIG. 3B, of a tip portion of the fuel injection valve in accordance with the first exemplary embodiment.
Figure 3B:
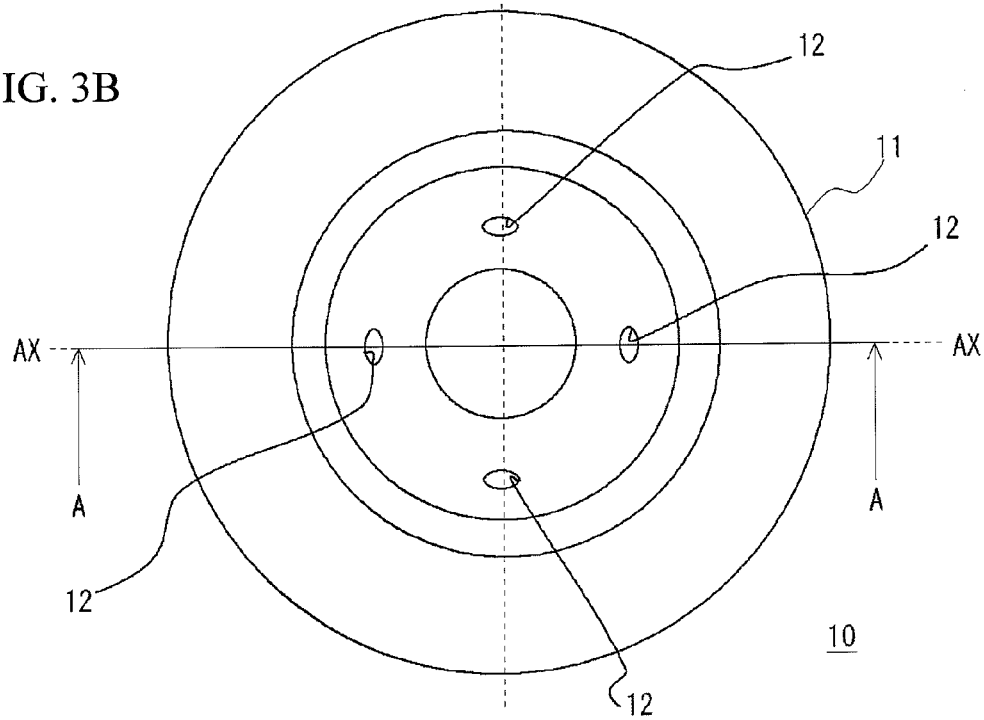
FIG. 3B is a view of a tip portion of the fuel injection valve in accordance with the first exemplary embodiment.

A description will now be given, with reference to FIG. 1A through FIG. 5B, of a first exemplary embodiment of a fuel injection valve of the present invention. FIG. 1A is an explanatory diagram illustrating a state where a nozzle body 11 and a needle 13 of a fuel injection valve 10 are not combined. FIG. 1B is an explanatory diagram illustrating a state where the needle 13 is implemented to the nozzle body 11 of the fuel injection valve 10. FIG. 2 is a cross-sectional view of the needle 13 provided to the fuel injection valve 10. FIG. 3A is a cross-sectional view, which is taken from line A-A of FIG. 3B, of a tip portion of the fuel injection valve. FIG. 3B is a view of the tip portion of the fuel injection valve in accordance with the first exemplary embodiment.

The fuel injection valve 10 is mounted to an internal combustion engine such as a gasoline engine for example, but the internal combustion engine is not limited to a gasoline engine, and may be a diesel engine using light oil as the fuel, or a flexible fuel engine using the fuel made by mixture of gasoline and alcohol in arbitrary proportions.

A description will now be given of an internal configuration of the fuel injection valve 10 which is one of embodiments of the present invention. The fuel injection valve 10 is provided with the nozzle body 11 to which an injection hole 12 is provided at a tip portion. Four injection holes 12 are provided as illustrated in FIG. 3B. An entry of each injection hole 12 opens into a corner portion where a bottom surface and a side surface of a swirl stabilization chamber 25 described later cross. The nozzle body 11 includes a seat position 11*a* therein. The fuel injection valve 10 includes the needle 13 which is slidably located in the nozzle body 11. The needle 13 forms a fuel injection passage 14 between the needle 13 and the nozzle body 11 as illustrated in FIG. 1B. The needle 13 includes a first eccentricity suppression portion 15 on the tip side, and includes a seat portion 13*a* seated on the seat position 11*a* inside the nozzle body 11 on the tip side of the needle 13. The first eccentricity suppression portion 15 suppresses the eccentricity of the needle 13 by being inserted into the nozzle body 11 with a slight clearance between the inner peripheral wall of the nozzle body 11 and the needle 13. The needle 13 is driven by a piezoelectric actuator.

The needle 13 includes a swirl flow generator 16 in the first eccentricity suppression portion 15. The swirl flow generator 16 is formed at the upstream side of the seat portion 13*a*. The swirl flow generator 16 includes a spiral groove 16*a* which swirls the fuel injected from the fuel injection passage 14. The number of rows of the spiral groove 16*a* may be at least one, and in this embodiment, two rows of spiral grooves 16*a* are provided.

As illustrated in FIG. 2, an air induction passage 17 is formed within the needle 13. An opening 18 at the exit side of the air induction passage 17 is located at the tip portion of the needle 13. The air induction passage 17 introduces the air from the base end portion to the tip portion of the fuel injection valve 10 in the same manner as the fuel. A check valve 19, which is spherical and biased by a spring 20, is provided near the opening 18 of the air induction passage 17. The check valve 19 opens when the pressure in the swirl stabilization chamber 25 described later becomes negative. The swirl flow generator 16, the air induction passage 17 and the swirl stabilization chamber 25 collaborate each other and function as air bubble generation means.

The needle 13 includes a second eccentricity suppression portion 21 closer to the base end side than the first eccentricity suppression portion 15. A round groove 22 is provided to the outer peripheral wall of the second eccentricity suppression portion 21. An opening 23 of the entry side of the air induction passage 17 is exposed to the groove 22. An air injection hole 24 is provided to the nozzle body 11. The air injection hole 24 is coupled to a surge tank. When the air injection hole 24 faces the groove 22, the air induction passage 17 is communicated with the surge tank. If the air injection hole 24 can introduce the air to the air induction passage 17, a component to which the air injection hole 24 is coupled is not limited to a surge tank.

As illustrated in FIGS. 1A, 1B and 3A, the nozzle body 11 includes the swirl stabilization chamber 25 at the tip portion. The fuel passing through the swirl flow generator 16 and the air passing through the air induction passage 17 are injected to the swirl stabilization chamber 25. In the swirl stabilization chamber 25, the flow velocity of the swirl flow of the fuel generated by the swirl flow generator 16 is accelerated, and the swirl flow becomes in a stable condition along the inner peripheral wall of the swirl stabilization chamber 25. When the swirl flow becomes stable, a negative pressure is generated in the central region of the swirl stabilization chamber 25. The opening 18 of the air induction passage 17 is located to face the central region of the swirl stabilization chamber 25 so that it is exposed to the negative pressure. Accordingly, the air is inducted to the negative pressure. As the negative pressure is low pressure, the air can be easily inducted. Moreover, the induction of the air by exposing the opening 18 of the air induction passage 17 to the negative pressure suppresses the disturbance of the swirl flow.

The fuel injected into the swirl stabilization chamber 25 takes in the air and generates fine air bubbles. The fine air bubbles are injected from the injection hole 12. After the injection, the fuel film forming the injected fine air bubbles splits, and the fuel turns into ultra-fine particles. As the fuel turns into ultra-fine particles, the shortening of the ignition delay time, the increase of the combustion speed, the prevention of the oil dilution, the prevention of the deposit accumulation, and the prevention of the occurrence of knocking are achieved in a balanced manner at a high level. An ultrasonic vibrator may be used as air bubble generation means.

Figure 4:
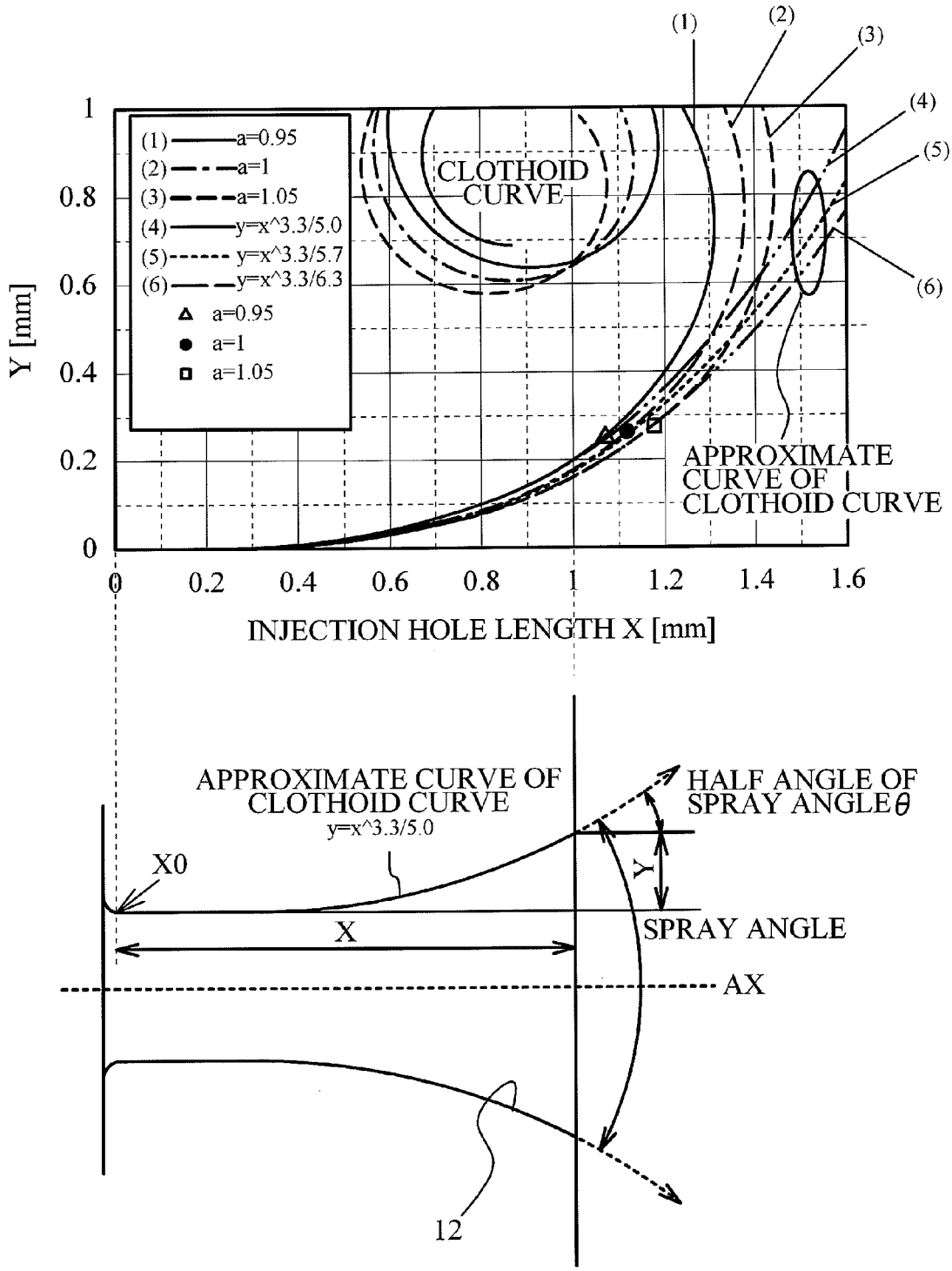
FIG. 4 is an explanatory diagram of a clothoid curve and an approximate curve of a clothoid curve included in an inner peripheral shape of an injection hole.
Figure 5A:
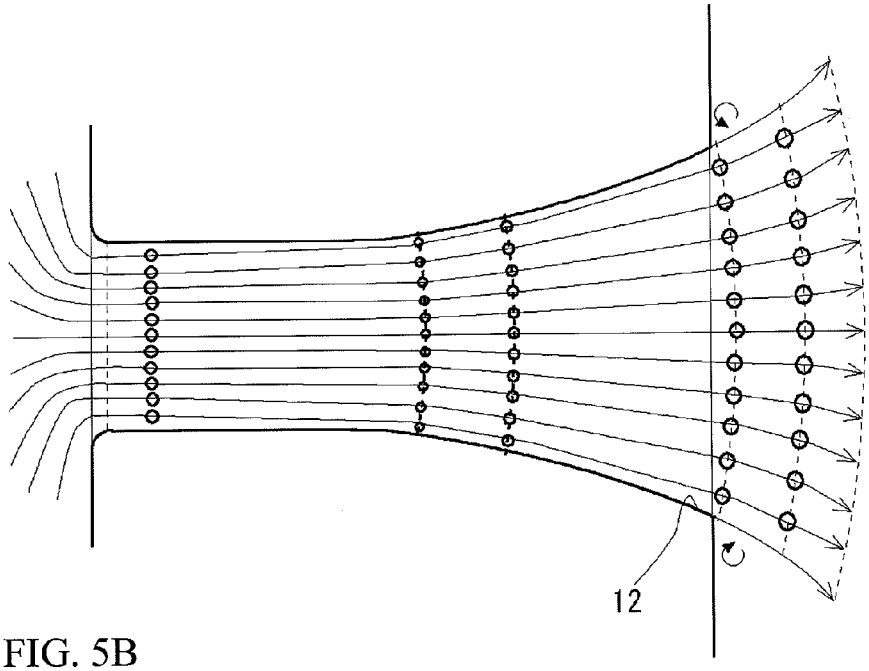
FIG. 5A is an explanatory diagram illustrating a transition of an air bubble size at fuel injection in the first exemplary embodiment.
Figure 5B:
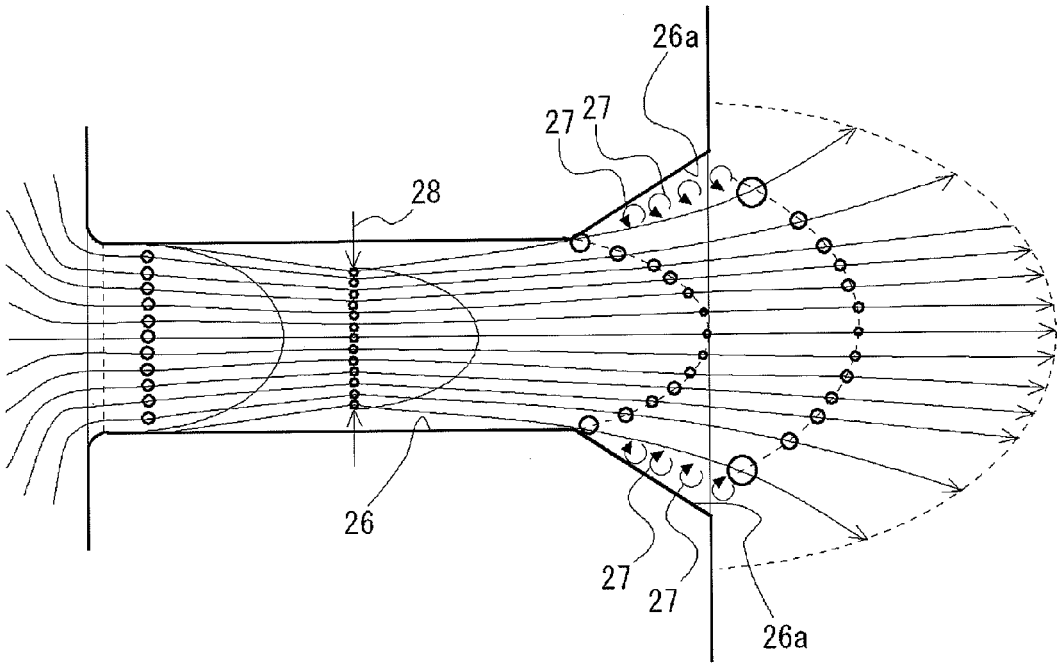
FIG. 5B is an explanatory diagram illustrating a transition of an air bubble size at fuel injection in a comparative example.

A description will now be given of the inner peripheral shape of the injection hole 12 in detail. FIG. 4 is an explanatory diagram of a clothoid curve and an approximate curve of a clothoid curve included in the inner peripheral shape of the injection hole 12 provided to the nozzle body 11. FIG. 5A is an explanatory diagram illustrating a transition of an air bubble size at fuel injection in the first exemplary embodiment, and FIG. 5B is an explanatory diagram illustrating a transition of an air bubble size at fuel injection in a comparative example.

The inner peripheral shape of the injection hole 12 includes a curving part which is a locus of an approximate curve of a clothoid curve as illustrated in FIG. 4. This approximate curve is expressed by $Y=X^{3.3}/5.0$ and indicated by (4) in FIG. 4. This approximate curve is expressed by $R\times L=a^2$ when a radius of curvature is R, a length of a curve is L, and a constant is a, and approximates a clothoid curve of which the constant a is 0.95. The curving part is from the entry opening to the exit opening indicated by X0 in FIG. 4.

An approximate curve is obtained as follows. Set the constant a to 0.95 in a clothoid curve expressed by $R\times L=a^2$. The value 0.95 of the constant a is a lower limit where the sprayed-fuel dripping hardly occurs within a range where a half angle of spray θ illustrated in FIG. 4 is smaller than 40 degrees. This range where the sprayed-fuel dripping hardly occurs is verified by the experiment. An experimental methodology is as follows. Firstly, injection hole models of which the inner peripheral shape is different from others are prepared. Then, the fuel injection in each injection hole model is captured with a high-speed camera, and the captured images are analyzed. Here, the actual injection hole model uses an approximate curve of a clothoid curve of which the constant a is 0.95. An approximate curve of a clothoid curve is expressed by the formula $Y=X^b/C$ when X is the axial-direction length of the injection hole, Y is the radial-direction length of the injection hole, and b and c are constants. In this formula, constants b and c are varied, and a curve of which the difference from an original clothoid curve is within 20 um is selected. As a result, 3.3 is selected as the constant b and 5.0 is selected as the constant c.

As a result of above experiment, a sharp rise of the probability of occurrences of the fuel dripping is observed at an approximate curve of a clothoid curve of which the constant a is 0.95. That is to say, when the constant a becomes smaller than 0.95, it is observed that the possibility of occurrences of the fuel dripping sharply rises. Thus, 0.95, which is within the range of the constant a, is selected, and an approximate curve expressed by $Y=X^{3.3}/5.0$ corresponding to the value 0.95 of the constant a is selected in this embodiment.

The plane of rotation of the curving part which is a locus of above approximate curve forms the inner peripheral shape of the injection hole 12. The fuel passing through the injection hole 12 having such an inner peripheral shape is drawn to the inner peripheral wall due to the Coanda effect. Thus, the fuel flow is not separated from the inner wall surface of the injection hole. As a result, the streamline direction of the fuel changes without the occurrence of negative pressure at the boundary surface. In addition, the streamline of the fuel that flows through the inner side of the boundary surface is bent by being affected by the fuel flowing over the boundary surface due to its viscosity. As described, as the streamline of the fuel gradually changes through the central region of the injection hole, the fuel flow keeps almost equal flow velocity and almost equal pressure in the whole region inside the injection hole, and can make the spray angle wide.

While fine air bubbles generated and mixed in the swirl stabilization chamber 25 flow through the injection hole, the size and the distribution of them are kept uniform. The fine air bubbles can form fine and uniform fuel bubbles after being injected to the external.

A description will now be given of the above state with reference to FIGS. 5A and 5B. A tapered surface 26*a* is formed at the exit opening in an injection hole 26 of the comparative example illustrated in FIG. 5B. The shape of the injection hole 26 is adapted for making the fine bubbles of the fuel by turning the fuel at the boundary with the air into a liquid film with the shear force of the liquid fuel and the air and splitting up the liquid film. Thus, it is important to increase the relative velocity difference between the air and the fuel, which means that the increase of the flow velocity of spray is important, for turning the fuel into fine bubbles. The tapered surface 26*a* is provided as illustrated in FIG. 5B, and air bubbles are generated by causing the separation on the tapered surface 26*a*. However, if air bubbles are generated in this manner, the negative pressure is generated by the velocity difference at the boundary surface, air bubbles swell because of the negative pressure, and the size of air bubbles may become non-uniform. In addition, coarse bubbles and coarse droplets may be generated. Furthermore, the contraction flow indicated with an arrow 28 may be generated inside the injection hole 26. When the contraction flow is generated, the crush of air bubbles occurs in the injection hole, and the erosion caused by the crush of air bubbles becomes a problem.

On the other hand, as illustrated in FIG. 5A, in the injection hole 12 to which an approximate curve of a clothoid curve is applied, as the fuel flows along the inner peripheral walls of the injection hole 12, the generation of negative pressure at the boundary surface is suppressed. As a result, the size of air bubbles becomes uniform, and the generation of coarse bubbles and coarse droplets are suppressed. In addition, the fuel where the distribution of air bubbles is homogeneous is injected along the inner peripheral wall, and it becomes possible to equalize the density of the air-fuel mixture.

It is difficult for the fuel injected from the injection hole 12 to adhere around the exit opening of the injection hole 12, and as a result, the generation of deposits near the injection hole 12 is suppressed considerably. However, if the spray angle (half angle of spray θ) illustrated in FIG. 4 becomes too wide, the stagnation and dripping of the fuel caused by the Coanda effect easily occur at the exit opening of the injection hole 12, and therefore it is desirable to make the half angle of spray θ narrower than a given angle. In FIG. 4, Δ, ● and □ indicate positions where the half angle of spray θ becomes 40° in each clothoid curve. When 40° is set as the half angle of spray with which the stagnation and dripping of the fuel easily occur, it is possible to set the half angle of spray narrower than 40° by the selections of the injection hole length and the constant a.

The inner peripheral shape of the injection hole 12 in accordance with the present exemplary embodiment uses the locus of an approximate curve of a clothoid curve expressed by $Y=X^{3.3}/5.0$, but can use the loci of other curves. In FIG. 4, the shape including a curving part passing through a region surrounded by a clothoid curve of which the constant a is 0.95 indicated by (1) and a clothoid curve of which the constant a is 1.05 indicated by (3) may be used. For example, a clothoid curve of which the constant a is 1.0 indicated by (2) may be adopted. A clothoid curve is expressed by a formula $R\times L=a^2$, and an X-coordinate and a Y-coordinate of a clothoid curve can be expressed by following formulas.

$$X(L)=a\times\int\cos(\phi^2/2)d\phi$$

$$Y(L)=a\times\int\sin(\phi^2/2)d\phi$$

The inner peripheral shape of the injection hole 12 may be a shape including a curving part passing through the region surrounded by an approximate curve of which the constant b is 3.3 and the constant c is 5.0 indicated by (4) and an approximate curve of which the constant b is 3.3 and the constant c is 6.3 indicated by (6) in FIG. 4. For example, in FIG. 4, an approximate curve of which the constant b is 3.3 and the constant c is 5.7 indicated by (5) may be adopted. The inner peripheral shape of the injection hole is not limited to the one that completely corresponds to a clothoid curve or an approximate curve of a clothoid curve, and may be a shape including a curving part included in the region described above.

A description will now be given of the constant a in a clothoid curve, constants b and c in an approximate curve of a clothoid curve. The range of the constant a in a clothoid curve may be from 0.95 to 1.05 as described above.

The value 0.95 of the constant a is the value decided in view of the possibility of occurrence of the fuel dripping as described above. On the other hand, the value 1.05 of the constant a is an upper limit where it is difficult for fine bubbles to be joined. This range where it is difficult for fine bubbles to be joined is verified by experiments. An experimental methodology is same as the methodology described above, and injection hole models of which inner peripheral shapes are different are prepared. Then, the state of fuel injection in each injection model is captured with a high-speed camera, and captured images are analyzed. Here, the actual injection hole model uses an approximate curve of a clothoid curve of which the constant a is 1.05. An approximate curve of a clothoid curve is a formula expressed by $Y=X^b/c$ when X is an axial-direction length of the injection hole, Y is a radial-direction length of the injection hole, and b and c are constants. In this formula, constants b and c are varied, and a curve of which the difference from an original clothoid curve is within 20 um is selected. As a result, 3.3 is selected as the constant b and 6.3 is selected as the constant c.

As a result of above experiment, a sharp rise of the probability of occurrences of fine bubbles joining is observed at an approximate curve of a clothoid curve of which the constant a is 1.05. That is to say, when the constant a becomes larger than 1.05, it is observed that the possibility of occurrences of fine bubbles joining sharply rises. Thus, 1.05, which is within the range of the constant a, is selected, and an approximate curve expressed by $Y=X^{3.3}/6.3$ corresponding to the value 1.05 of the constant a is selected in this embodiment.

As described above, according to the fuel injection valve 10, it is possible to suppress the crush of air bubbles. Thus, it is possible to prevent the injected fuel from reaching an inner peripheral wall of the internal combustion engine body in liquid form. In addition, it is possible to generate a homogeneous air-fuel mixture in the whole of the combustion chamber evenly. As a result, it is possible to reduce the emission of NOx (nitrogen oxide) considerably in addition to HC (hydrocarbon) and CO (carbon monoxide) because it is possible to take in enough oxygen. Furthermore, as it becomes unnecessary to mix a swirl, a tumble and the like, the heat transfer to the inner wall of the combustion chamber during combustion is considerably reduced, and the reduction of cooling loss and the increase in thermal efficiency are expected.

[Second Exemplary Embodiment]

Figure 6A:
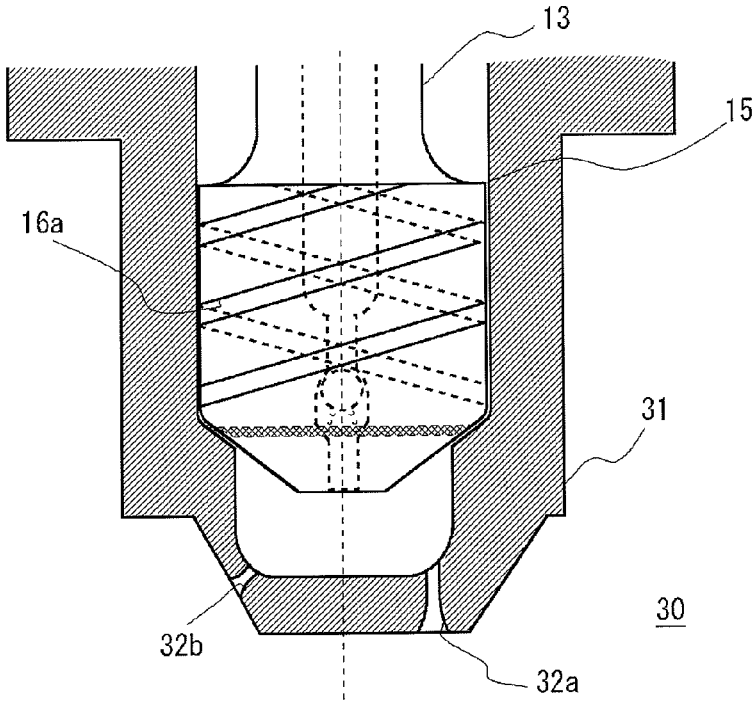
FIG. 6A is a cross-sectional view, which is taken from line B-B of FIG. 6B, of a tip portion of a fuel injection valve in accordance with a second exemplary embodiment.
Figure 6B:
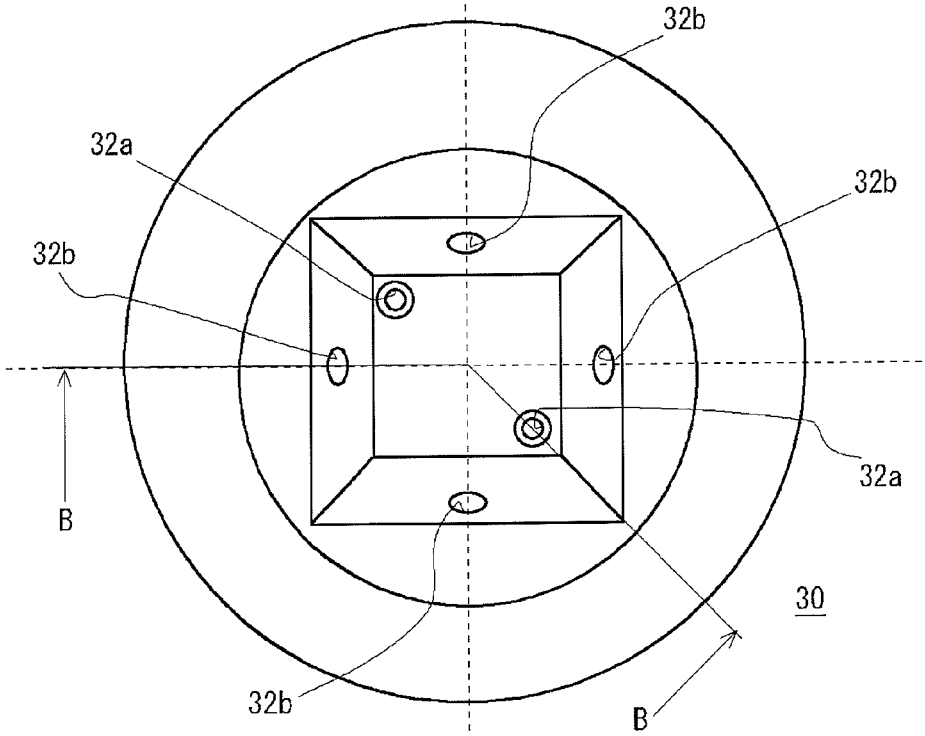
FIG. 6B is a view of the tip portion of the fuel injection valve in accordance with the second exemplary embodiment.
Figure 7:
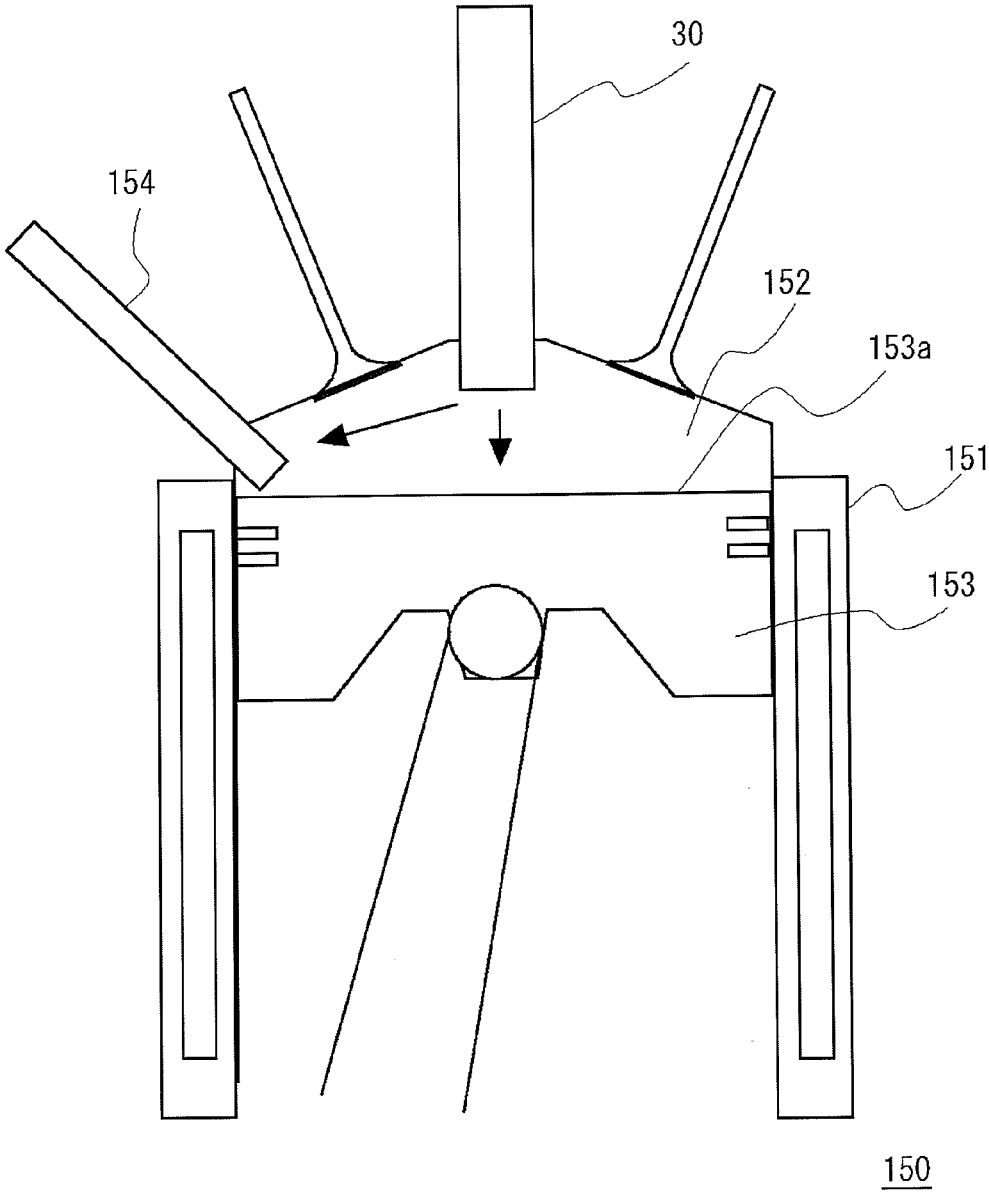
FIG. 7 is an explanatory diagram schematically illustrating an internal combustion engine to which the fuel injection valve in accordance with the second exemplary embodiment is implemented.
Figure 8:
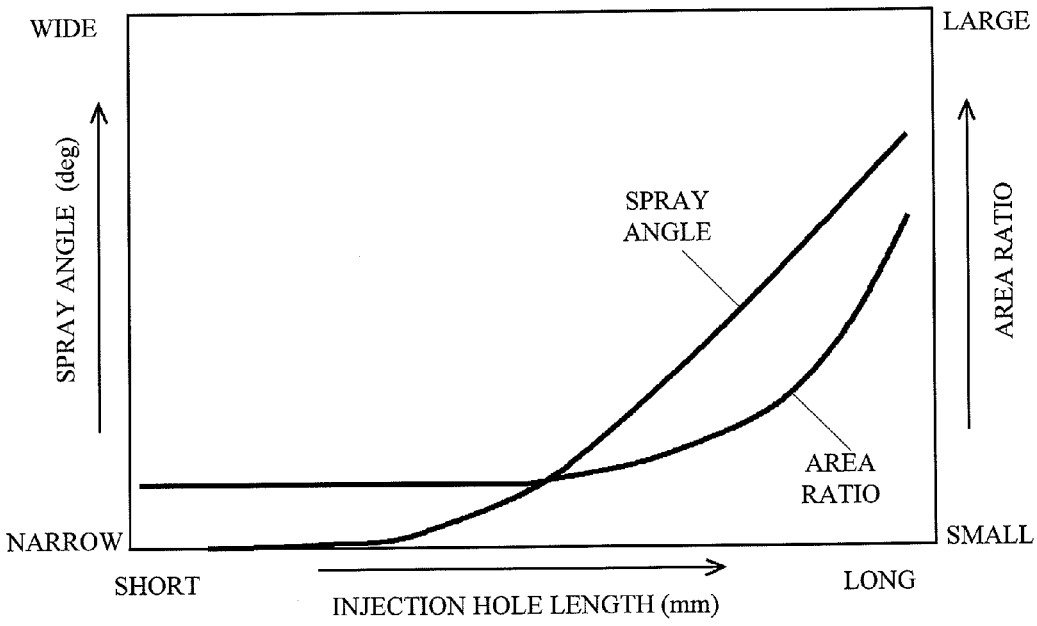
FIG. 8 is an explanatory diagram illustrating a relationship between the injection hole length and a spray angle or an area ratio.

A description will now be given of a second exemplary embodiment with reference to FIG. 6A through FIG. 8. FIG. 6A is a cross-sectional view, which is taken from line B-B of FIG. 6B, of a tip portion of a fuel injection valve 30. FIG. 6B is a view of the tip portion of the fuel injection valve 30. FIG. 7 is an explanatory diagram schematically illustrating an internal combustion engine 150 to which the fuel injection valve 30 is implemented. FIG. 8 is an explanatory diagram illustrating a relationship between the injection hole length and a spray angle or an area ratio.

The internal combustion engine 150 includes an internal combustion engine body 151 provided with a combustion chamber 152. The fuel injection valve 30 is mounted to the combustion chamber 152 with its tip portion being exposed. The fuel injection valve 30 is located in the central region of the combustion chamber 152. In addition, a piston 153 is mounted in the internal combustion engine body 151. Furthermore, a spark plug 154 is mounted to the combustion chamber 152 with its tip being exposed.

As described above, when the fuel injection valve 30 is located in the central region of the combustion chamber 152, the distance from the fuel injection valve 30 to the top 153*a* of the piston 153 is short, and the distance from the fuel injection valve 30 to the inner peripheral wall of the combustion chamber is long. That is to say, the distance to the inner wall surface of the internal combustion engine body 151 is greatly different between the downward injection and the sideways injection. Accordingly, if countermeasures are not taken, the spray by the downward injection collides against the top 153*a* of piston and turns into a liquid film. Moreover, as air bubbles of the spray injected by the sideways injection crash before reaching near the inner peripheral wall of the combustion chamber, the homogeneous air-fuel mixture is not easily generated.

Thus, the fuel injection valve 30 includes a first injection hole 32*a* and a second injection hole 32*b* illustrated in FIG. 6A and FIG. 6B. The fuel injection valve 30 includes the needle 13 which is same as that of the fuel injection valve 10 in the first exemplary embodiment, but includes a nozzle body 31 instead of the nozzle body 11 in the first exemplary embodiment. The nozzle body 31 includes the first injection hole 32*a* for the downward injection and the second injection hole 32*b* for the sideways injection. The first injection hole 32*a* and the second injection hole 32*b* have a curving part using a locus of an approximate curve of a common clothoid curve, but each injection hole length is different, and as a result, each spray angle is different. As illustrated in FIG. 8, when the locus of the same curve is used, the spray angle becomes large as the injection hole length becomes large. As the spray angle becomes large, the flow velocity of the spray is reduced and the reachable distance becomes short. Therefore, it is effective to make the injection hole length long and to make the spray angle wide when making the spray's reachable distance short. The fuel injection valve 30 has a same configuration as that of the fuel injection valve 10 of the first exemplary embodiment with the exception of the differences in the location and the inner peripheral shape of the injection hole.

The spray's reachable distance is desired to be short because the distance from the first injection hole 32*a* provided to the fuel injection valve 30 to the top 153*a* of piston is short. On the other hand, as the distance from the second injection hole 32*b* to the inner peripheral wall of the combustion chamber is long, the spray's reachable distance is desired to be long. Thus, the injection hole length of the first injection hole 32*a* is shorter than the injection hole length of the second injection hole 32*b*, and the spray angle of the first injection hole 32*a* is wider than the spray angle of the second injection hole 32*b*. As a result, the spray's reachable distance is made short.

As described above, it is possible for air bubbles in so-called dry fog conditions to reach a desired location without being crushed by setting the spray angle properly. In addition, as it is prevented that the injected fuel reaches the inner wall surface of the internal combustion engine body in a liquid form, the dilution of the oil by the fuel is prevented.

It is possible to set the constant of the curve to achieve the desired spray angle in addition to the setting of the injection hole length to set the desired spray angle. For example, when a clothoid curve is adopted, it is possible to set the desired spray angle by selecting the constant a properly. In addition, when setting a desired spray angle under the condition where the fuel injection valve has a design constraint and the injection hole length is determined, it is possible to maintain the injection hole length as a curving part of similar figures obtained by enlarging the curve with which the desired spray angle is achieved.

[Third Exemplary Embodiment]

Figure 9A:
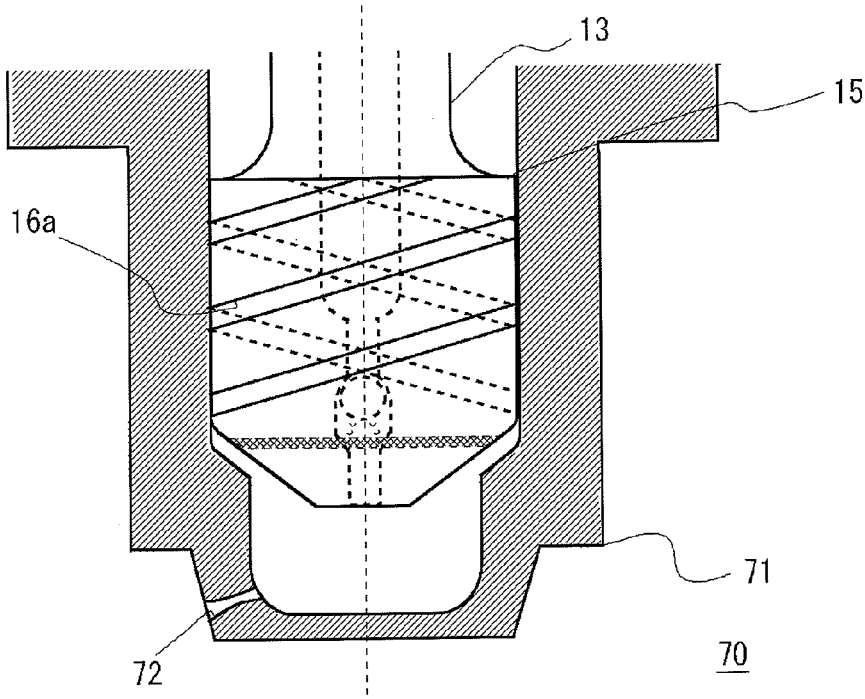
FIG. 9A is a cross-sectional view, which is taken from line C-C of FIG. 9B, of a tip portion of a fuel injection valve in accordance with a third exemplary embodiment.
Figure 9B:
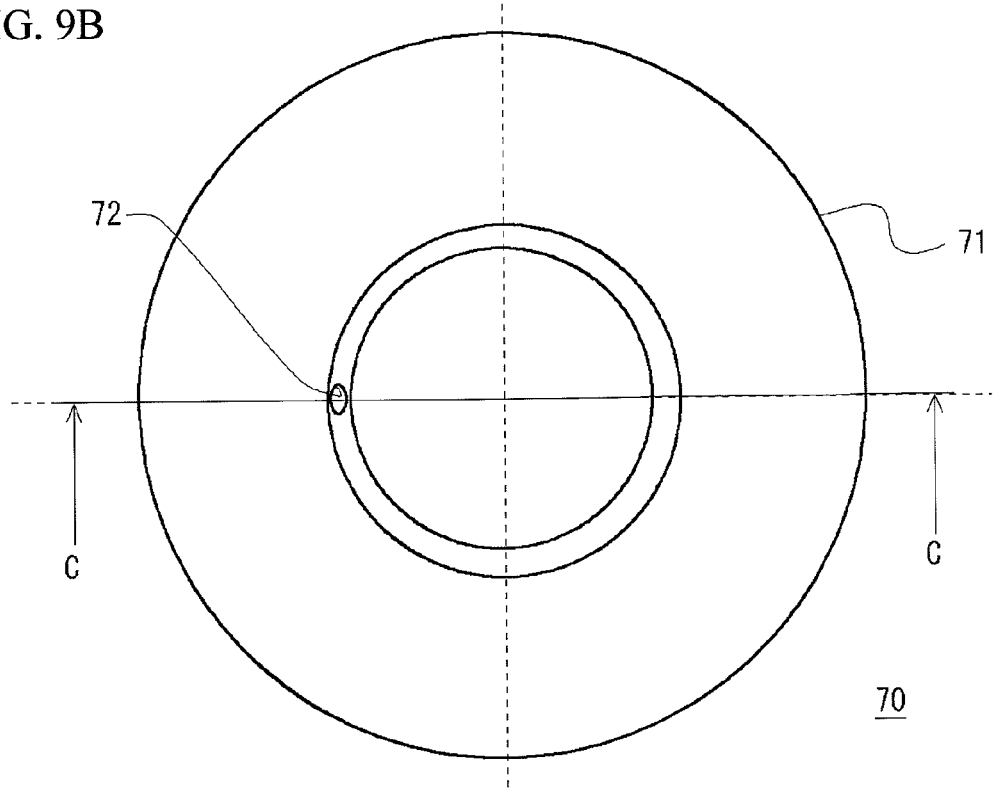
FIG. 9B is a view of a tip portion of the fuel injection valve in accordance with the third exemplary embodiment.
Figure 10:
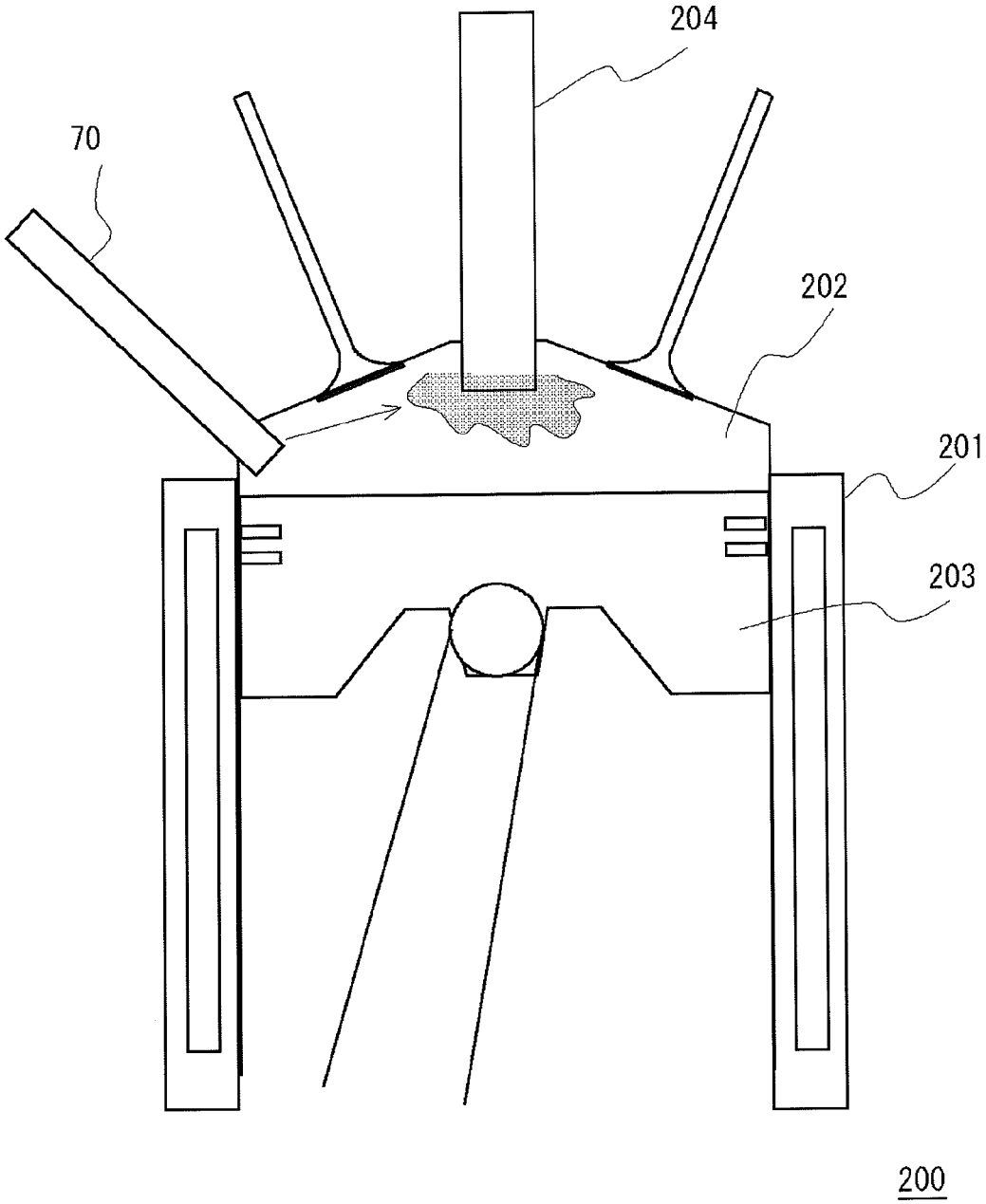
FIG. 10 is an explanatory diagram schematically illustrating an internal combustion engine to which the fuel injection valve in accordance with the third exemplary embodiment is implemented.

A description will now be given of a third exemplary embodiment with reference to FIG. 9 and FIG. 10. FIG. 9A is a cross-sectional view, which is taken from line C-C of FIG. 9B, of a tip portion of a fuel injection valve 70. FIG. 9B is a view of a tip portion of the fuel injection valve 70. FIG. 10 is an explanatory diagram theschematically illustrating an internal combustion engine 200 to which the fuel injection valve 70 is implemented.

The internal combustion engine 200 includes an internal combustion engine body 201 provided with a combustion chamber 202. The fuel injection valve 70 is mounted to the combustion chamber 202 with its tip portion begin exposed. The fuel injection valve 70 is located lateral to the combustion chamber 202. In addition, a piston 203 is mounted to the internal combustion engine body 201. Furthermore, a spark plug 204 is mounted to the central region of the combustion chamber 202 with its tip being exposed.

As described above, when the fuel injection valve 70 and the spark plug 204 are provided, it is desirable that an injection hole 72 provided to the fuel injection valve 70 opens into the spark plug 204 to form a stratified air-fuel mixture. More specifically, the spray angle and the injection hole length are set properly.

Thus, the fuel injection valve 70 is provided with a nozzle body 71 including the injection hole 72. The injection hole 72 has a curving part using a locus of an approximate curve of a clothoid curve. Here, a clothoid curve and an approximate curve of a clothoid curve can be selected according to the principle described in the first exemplary embodiment. Moreover, the injection hole length (e.g. 0.7 mm) is adjusted so that the spray angle is set (e.g. the half angle of spray is 30°) so that the spray center is directed to the tip portion of the spark plug 204. The fuel injection valve 70 has a same configuration as that of the fuel injection valve 10 in the first exemplary embodiment with the exception of differences in the location and the inner peripheral shape of the injection hole.

The fuel injection valve 70 injects the fuel of which the amount is necessary for a stratified air-fuel mixture at a late stage of the compression stroke when the internal combustion engine 200 is under light load conditions. In addition, the fuel injection valve 70 injects the fuel of which the amount is necessary for obtaining an output during the intake stroke prior to the injection at the late stage of the compression stroke when the internal combustion engine 200 is under high load conditions. According to this, the atomization of the fuel is promoted by crashing air bubbles early, and the fuel is spread to the whole of the combustion chamber 202 by the intake air flow.

The fuel injection valve 70 can form a homogeneous stratified air-fuel mixture near the tip portion of the spark plug 204 with the necessary amount of the fuel by performing the injection described above. Moreover, as almost homogeneous stratified air-fuel mixture can be formed, a stratified air-fuel mixture leaner than stoichiometric conditions where the ignition is possible may be formed. According to this, a local over rich condition is not easily created, and it is possible to suppress HC, soot and PMP (Particulate Matter) substantially. Furthermore, it becomes possible to eliminate a cavity and the like for forming a stratified air-fuel mixture, and as a result, it becomes possible to make the surface area of the combustion chamber 202 small and reduce the cooling loss.

[Fourth Exemplary Embodiment]

Figure 11:
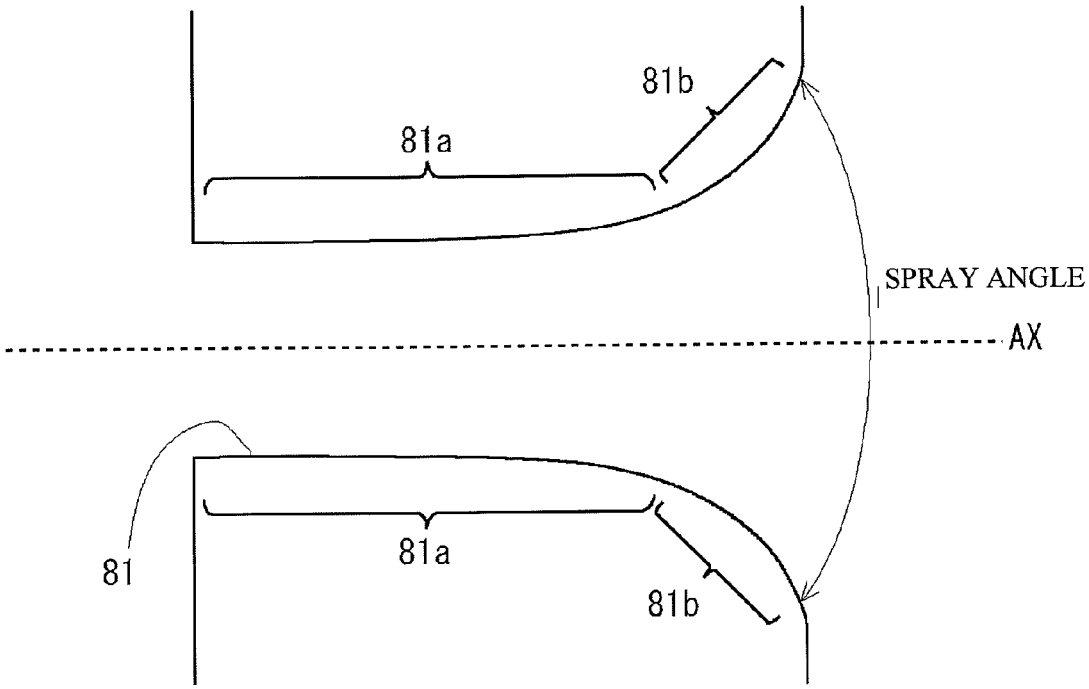
FIG. 11 is an explanatory diagram illustrating a shape of an injection hole in accordance with a fourth exemplary embodiment.

A description will now be given of a fourth exemplary embodiment with reference to FIG. 11. FIG. 11 is an explanatory diagram illustrating a shape of an injection hole 81 in the fourth exemplary embodiment.

The inner peripheral shape of the injection hole 81 illustrated in FIG. 11 has a curving part, which is formed by connecting an approximate curve of a clothoid curve with a circular arc, at the cross-section surface along the direction of axis AX of the injection hole 81. The injection hole 81 has an inner peripheral shape formed as the rotational plane of such a curving part.

In FIG. 11, the shape of the region which is located at the side near the entry opening of the injection hole 81 and indicated by the reference numeral 81*a* is represented by the locus of an approximate curve of a clothoid curve. Moreover, the shape of the region which is located at the side near the exit opening of the injection hole 81 and indicated by the reference numeral 81*b* is represented by the locus of the circular arc. The region indicated by the reference numeral 81*a* may have a shape represented by the locus of a clothoid curve. In addition, it may have a shape represented by the loci of other curves. Furthermore, other curves can be combined instead of the circular arc. Here, a clothoid curve and an approximate curve of a clothoid curve are selected according to the principle described in the first exemplary embodiment.

As described above, it becomes possible to make the spray angle at the exit opening of the injection hole 81 close to 180° by combining an approximate curve of a clothoid curve with a circular arc. It is possible to suppress the adhesion of the fuel to the top of piston by making the spray angle wide even though the injection valve is adopted to a flat combustion chamber of which the compression ratio is high.

[Fifth Exemplary Embodiment]

Figure 12:
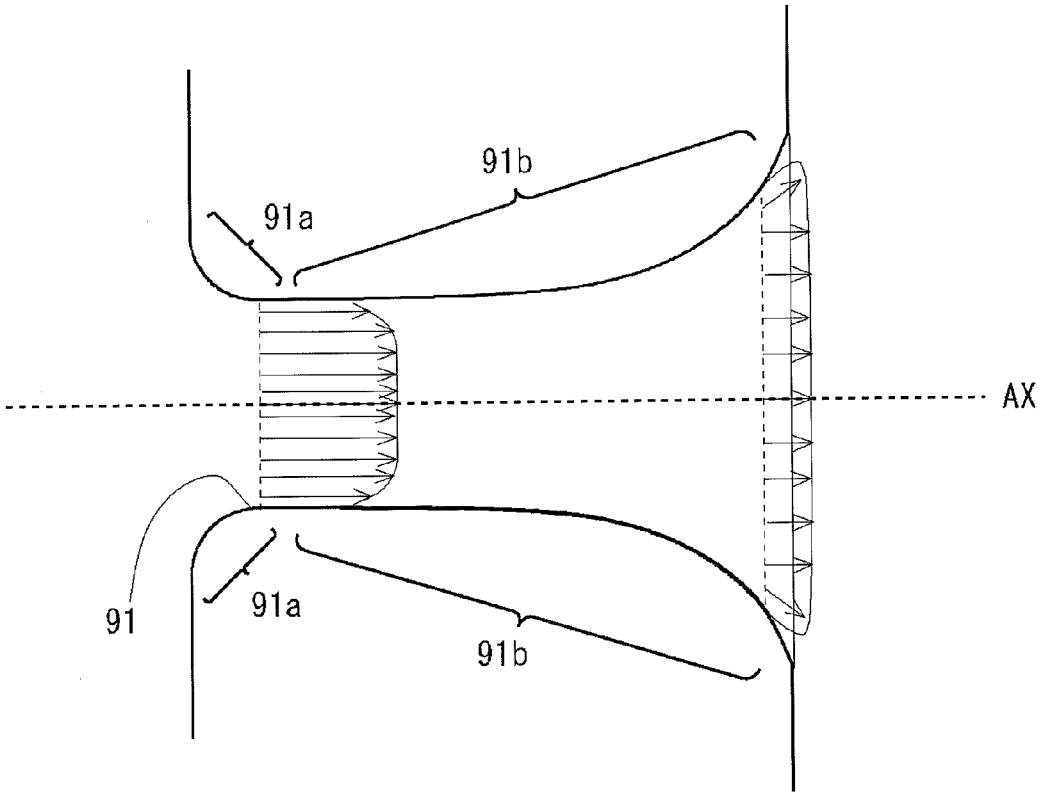
FIG. 12 is an explanatory diagram illustrating a shape of an injection hole in accordance with a fifth exemplary embodiment.

A description will now be given of a fifth exemplary embodiment with reference to FIG. 12. FIG. 12 is an explanatory diagram illustrating a shape of an injection hole 91 in the fifth exemplary embodiment.

The inner peripheral shape of the injection hole 91 has a curving part, which is formed by connecting an approximate curve of a clothoid curve with a circular arc, near the entry opening indicated by the reference numeral 91*a* in FIG. 12 at the cross-section surface along the direction of axis AX of the injection hole 91. In addition, in FIG. 12, it has a curving part formed by an approximate curve of a clothoid curve indicated by the reference numeral 91*b*. The injection hole 91 has an inner peripheral shape formed as the rotational plane of such a curving part. The curving part near the entry opening indicated by the reference numeral 91*a* may be only a clothoid curve or only an approximate curve of a clothoid curve. In addition, the curving part indicated by the reference numeral 91*b* may be formed by other curves. Here, a clothoid curve and an approximate curve of a clothoid curve are selected according to the principle described in the first exemplary embodiment.

The injection hole 91 has a smallest opening inside the injection hole 91 by having the curving part at the entry opening. As the injection hole 91 can create a laminar flow from the entry opening, it is possible to equalize the density of air bubbles in the fuel stably.

[Sixth Exemplary Embodiment]

Figure 13A:
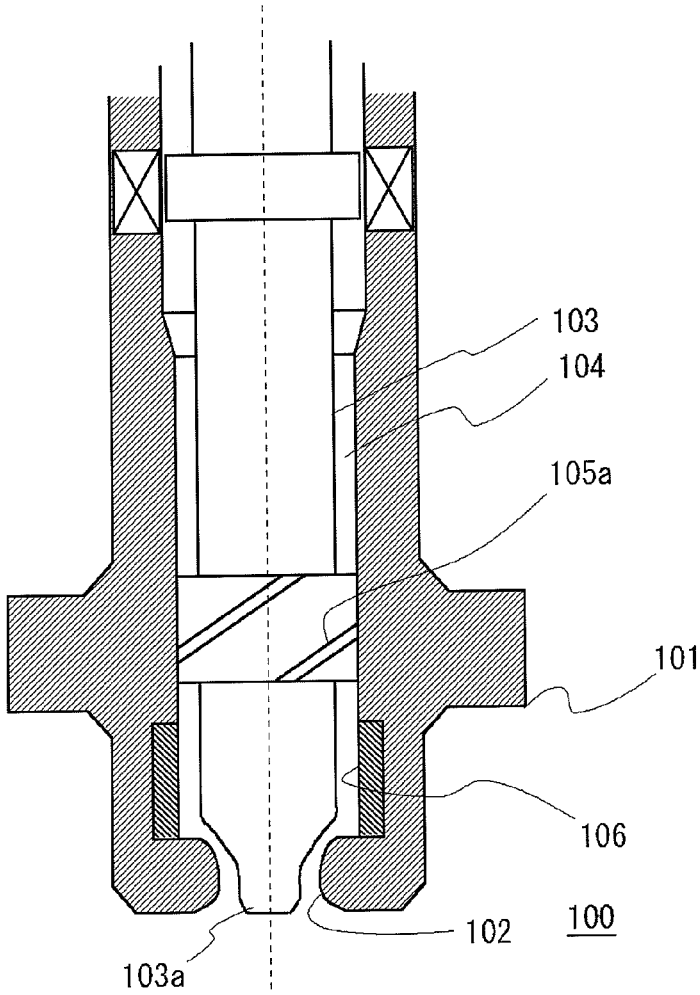
FIG. 13A is a cross-sectional view, which is taken from line D-D of FIG. 13B, of a fuel injection valve in accordance with a sixth exemplary embodiment.
Figure 13B:
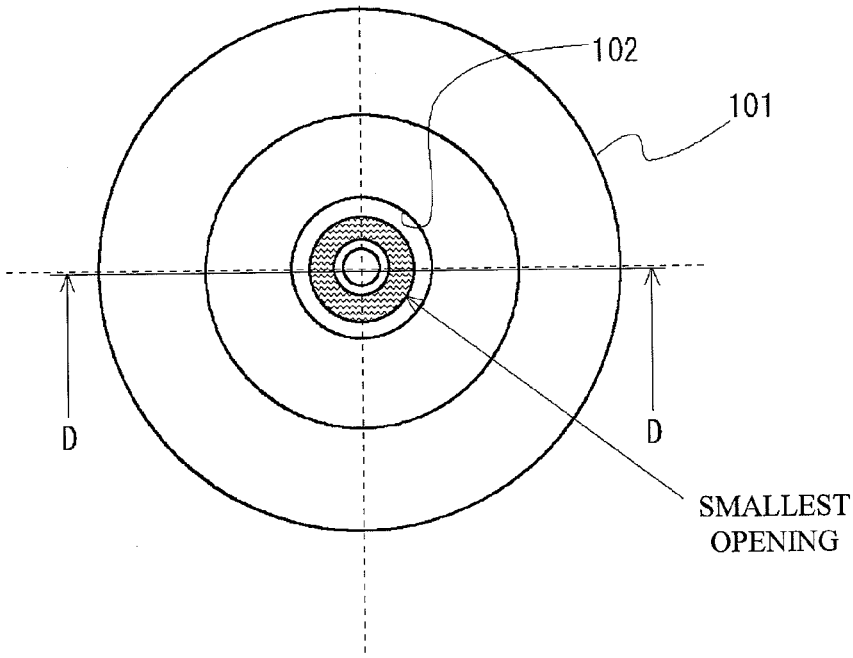
FIG. 13B is a view of a tip portion of the fuel injection valve in accordance with the sixth exemplary embodiment.
Figure 14:
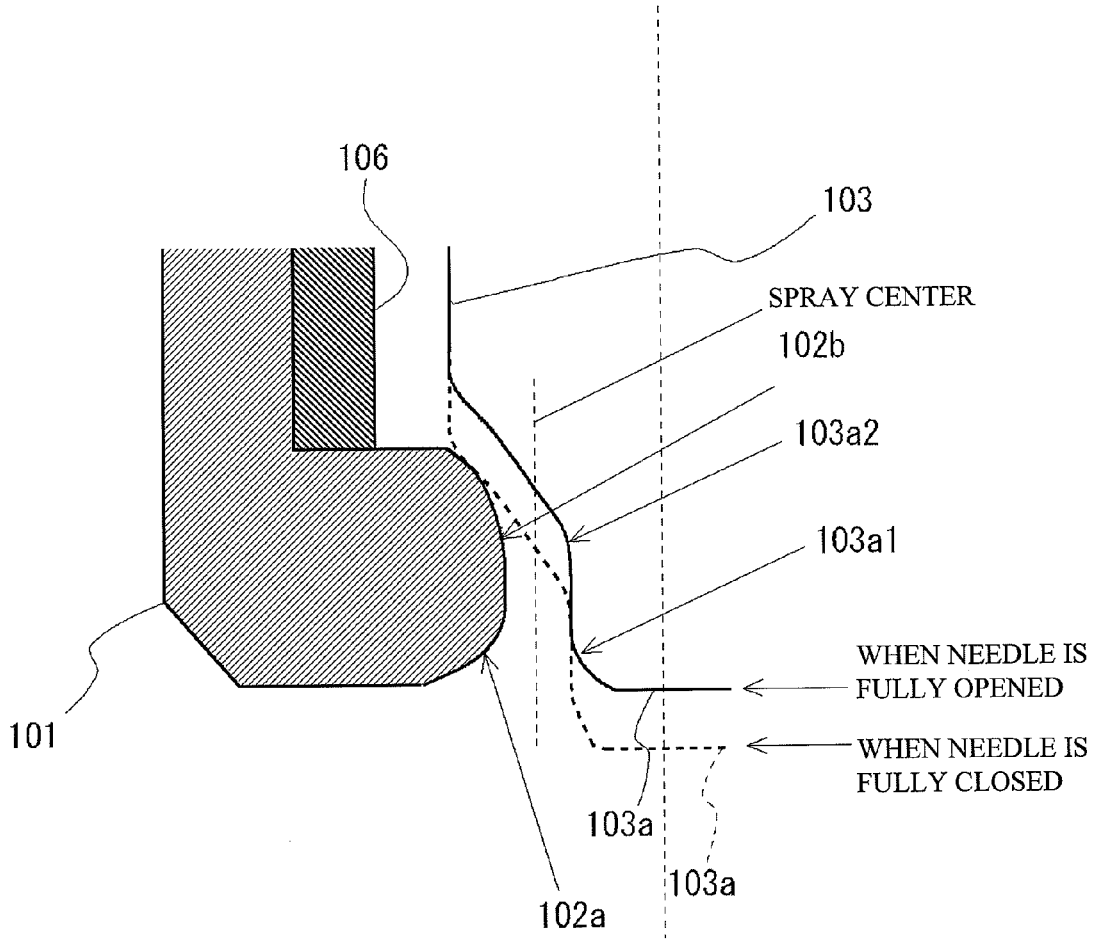
FIG. 14 is an explanatory diagram enlarging a tip portion of the fuel injection valve in accordance with the sixth exemplary embodiment.

A description will now be given of a sixth exemplary embodiment with reference to FIG. 13A through FIG. 14. FIG. 13A is a cross-sectional view, which is taken from line D-D of FIG. 13B, of a fuel injection valve 100. FIG. 13B is a view of a tip portion of the fuel injection valve 100. FIG. 14 is an explanatory diagram enlarging the tip portion of the fuel injection valve 100.

The fuel injection valve 100 is a so-called pintle type fuel injection valve. The fuel injection valve 100 is provided with a nozzle body 101 having an injection hole 102 at its tip portion. In addition, the fuel injection valve 100 is provided with a needle 103 of which the tip is exposed from the injection hole 102. A fuel injection passage 104 is formed between the needle 103 and the nozzle body 101. An eccentricity suppression portion 105, to which a spiral groove 105*a* is provided, is provided to the needle 13. The spiral groove 105*a* swirls the fuel. The fuel injection valve 100 is provided with an ultrasonic vibrator 106 as air bubble generation means.

The inner peripheral shape of the injection hole 102 includes a curving part which is a locus of an approximate curve of a clothoid curve. More specifically, the part indicated by the reference numeral 102*a* in FIG. 14 and the part indicated by the reference numeral 102*b* form the curving part described above. The injection hole 102 forms the exit opening which broadens toward the combustion chamber by making the part indicated by the reference numeral 102*a* a curving part.

On the other hand, in a tip portion 103*a* of the needle 103, the part indicated by the reference numeral 103*a*1 in FIG. 14 and the part indicated by the reference numeral 103*a*2 form the curving part. The curving part indicated by the reference numeral 103*a*1 is designed to be line symmetrical to the curving part indicated by the reference numeral 102*a* about the spray center when the needle 103 fully opens. The curving part indicated by the reference numeral 103*a*2 has a shape duplicating the curving part indicated by the reference numeral 102*b*.

The shape of the injection hole is easily changed by the lift amount of the pintle type fuel injection valve which adjusts the fuel injection amount by the lift amount of the needle 103. Thus, as described in this exemplary embodiment, if the inner peripheral shape of the injection hole 102 is made the shape of the tip portion 103*a* of the needle 103, it is possible to suppress the separation at the boundary surface with the fuel even though the fuel flow rate is highest, which means the condition where the needle is fully opened and the flow velocity of the fuel is high. As a result, it is possible to inject the fuel with keeping the air bubble size uniform. In addition, as the direction of the fuel injection can be symmetric, it is possible to obtain the balanced spray.

Moreover, when the fuel injection valve 100 of this exemplary embodiment is mounted to the central region of the combustion chamber, it is possible to form a fuel bubble cloud of which a shape includes an empty space at the central region. Then, it is possible to form a homogeneous air-fuel mixture in the whole of the combustion chamber without the adhesion of the droplet or the liquid film to the inner wall of the combustion chamber caused by the crush of air bubbles of fuel bubbles. As a result, the improvement of the fuel efficiency is expected, and HC and CO can be reduced. Furthermore, as an air-fuel mixture is not formed at the side-wall side of the combustion chamber, it is possible to suppress the knocking which tends to occur at the last stage of the combustion. As a result, a high compression ratio and a high supercharging can be achieved.

The present invention is not limited to the specifically described embodiments and variations, but other embodiments and variations may be made without departing from the scope of the claimed invention.

DESCRIPTION OF LETTERS OR NUMERALS

10, 30, 50, 70, 100 fuel injection valve
11 nozzle body
11*a* seat position
11*b* inner peripheral wall
12, 32, 52, 72, 81, 91, 102 injection hole
13 needle
13*a* seat portion
13*b* inner peripheral wall
14 fuel injection passage
15 first eccentricity suppression portion
16 swirl flow generator
36*a* spiral groove
17 air induction passage
18 opening
19 check valve
20 spring
150, 200 internal combustion engine

The invention claimed is:

1. A fuel injection valve comprising:

a nozzle body which is provided with an injection hole at a tip portion;

a needle that is located slidably in the nozzle body and includes a seat portion which is seated on a seat position in the nozzle body; and an air bubble generation portion that generates air bubbles in a fuel flowing through the nozzle body, wherein in a case where a curvature radius is R, a length of a curve is L and a constant is a, an inner peripheral shape of the injection hole includes a curving part passing through a region surrounded by a clothoid curve which is expressed by $R \times L = a^2$ and of which the constant a is 0.95 and a clothoid curve of which the constant a is 1.05 or a region surrounded by approximate curves of the clothoid curves at a cross-section surface along a direction of axis of the injection hole.

2. The fuel injection valve according to claim 1, wherein the approximate curves of the clothoid curves are expressed by $Y=X^b/c$ when X is an axial-direction length of the injection hole, Y is a radial-direction length of the injection hole, and b and c are constants, and the region surrounded by the approximate curves of the clothoid curves is a region surrounded by an approximate curve of which the constant b is 3.3 and the constant c is 5.0 and an approximate curve of which the constant b is 3.3 and the constant c is 6.3.

3. The fuel injection valve according to claim 1, wherein the inner peripheral shape of the injection hole includes a curving part formed by connecting a clothoid curve or an approximate curve of a clothoid curve with a circular arc at the cross-section surface along the direction of axis of the injection hole.

4. The fuel injection valve according to claim 1, wherein the air bubble generation portion includes:

a fuel injection passage formed between the needle and the nozzle body with the needle being located slidably in the nozzle body;

a swirl flow generator which is formed at an upstream side of the seat portion of the needle and where a spiral groove, which swirls a fuel injected from the fuel injection passage, is formed;

an air induction passage formed within the needle; and a swirl stabilization chamber which is formed at the tip portion of the nozzle body and to which a fuel passing through the swirl flow generator and an air passing through the air induction passage are injected.

5. The fuel injection valve according to claim 1, wherein the air bubble generation portion is an ultrasonic vibrator located in the nozzle body.

6. An internal combustion engine comprising:

an internal combustion engine body; and a fuel injection valve which is mounted to the internal combustion engine body so that a tip portion thereof is exposed in a combustion chamber or intake port of the internal combustion engine body, the fuel injection valve including:

a nozzle body which is provided with an injection hole at the tip portion;

a needle that is located slidably in the nozzle body and includes a seat portion which is seated on a seat position in the nozzle body; and an air bubble generation portion that generates air bubbles in a fuel flowing through the nozzle body, wherein in a case where a curvature radius is R, a length of a curve is L and a constant is a, an inner peripheral shape of the injection hole including a curving part passing through a region surrounded by a clothoid curve which is expressed by $R \times L = a^2$ and of which the constant a is 0.95 and a clothoid curve of which the constant a is 1.05 or a region surrounded by approximate curves of the clothoid curves at a cross-section surface along a direction of axis of the injection hole, and wherein a spray angle of the injection hole becomes narrow as a distance from the injection hole to an inner wall surface of the internal combustion engine body becomes long.

* * * * *